United States Patent [19]

Huber

[11] 4,121,656

[45] Oct. 24, 1978

[54] HEADER

[75] Inventor: Ferdinand Vincent Huber, Canton, Ohio

[73] Assignee: Ecodyne Corporation, Lincolnshire, Ill.

[21] Appl. No.: 801,198

[22] Filed: May 27, 1977

[51] Int. Cl.[2] ..... F28F 9/22

[52] U.S. Cl. ..... 165/72; 165/95; 165/110; 165/174; 165/176

[58] Field of Search ..... 165/110, 111, 176, 174, 165/75, 72, 95

[56] References Cited

U.S. PATENT DOCUMENTS

| | | | |
|---|---|---|---|
| Re. 21,270 | 11/1939 | Feidmeier | 165/75 |
| 1,810,286 | 6/1931 | MacPhee | 165/111 |
| 1,884,080 | 10/1932 | Miller | 165/176 |
| 1,925,711 | 9/1933 | Batchell | 165/173 |
| 1,955,015 | 4/1934 | Price | 165/176 |
| 2,028,213 | 1/1936 | Hemphill | 165/175 |
| 2,110,024 | 3/1938 | Miller | 165/176 |
| 2,200,787 | 5/1940 | Coy | 165/176 |
| 2,415,154 | 2/1947 | Walter | 165/176 |
| 2,608,388 | 8/1952 | Miller | 165/175 |
| 3,067,818 | 12/1962 | Ware et al. | 165/174 |
| 3,155,404 | 11/1964 | Brown, Jr. et al. | 165/176 |
| 3,229,761 | 1/1966 | Ware | 165/174 |
| 3,705,621 | 12/1972 | Schoonman | 165/176 |
| 3,759,319 | 9/1973 | Ritland et al. | 165/111 |

*Primary Examiner*—Ronald H. Lazarus
*Assistant Examiner*—Sheldon Richter
*Attorney, Agent, or Firm*—Charles M. Kaplan; Joel E. Siegel

[57] ABSTRACT

In a heat exchanger for condensing a gas by passage through vertically spaced heat exchange tubes, flooding of the lower tubes is prevented. A return flow header includes nested baffles which define isolated flow channels connecting one or more predetermined upper heat exchange tubes with a single predetermined lower heat exchange tube. This prevents the condensed liquid in the header from completely filling the lowermost tube or tubes. Removable plugs or plates permit access to the inside of the heat exchange tubes for cleaning.

12 Claims, 3 Drawing Figures

HEADER

BACKGROUND OF THE INVENTION

Gases, such as steam are commonly condensed into a liquid by flowing them through the horizontal tubes of a heat exchanger. Multiple pass, multi-layered tube designs are usually avoided because the condensed fluid from the first or subsequent passes flows to the bottom of a header where it floods the lowermost tubes. This causes subcooling of the liquid and elimination of the flooded tubes as condensing surfaces. This problem can be avoided by using pairs of tubes connected by U-bends to isolate the fluid in each such pair of tubes. However, the U-bend portions are not readily accessible for cleaning, and leaks are common because of erosion caused by the kinetic energy of the fluid flowing around the bends.

SUMMARY OF THE INVENTION

Accordingly, it is an object of this invention to provide an improved heat exchanger for condensing gas to liquids.

Another object is to provide a return header for a heat exchanger where fluid flow is isolated into separate channels without employing tubes having U-bends.

Another object is to provide a heat exchanger with a return header in which the fluid flows in isolated channels between predetermined tubes, but the inside of all tubes is readily accessible through such return header for cleaning.

Another object is to provide a heat exchanger header with baffles that can be designed to the full stress capability of the metals employed.

Another object is to provide a heat exchanger header where leaks and worn parts are easy to repair.

Another object is to provide a heat exchanger in which one or more predetermined upper tubes can be connected to a single predetermined lower tube by an isolated flow channel.

Another object is to provide a heat exchanger return flow header that is relatively inexpensive, rugged, easily cleaned and maintained, and which does not contain defects found in similar prior art devices.

Other objects and advantages of the invention will be revealed in the specification and claims, and the scope of the invention will be pointed out in the claims.

DESCRIPTION OF THE INVENTION

Figure 1:
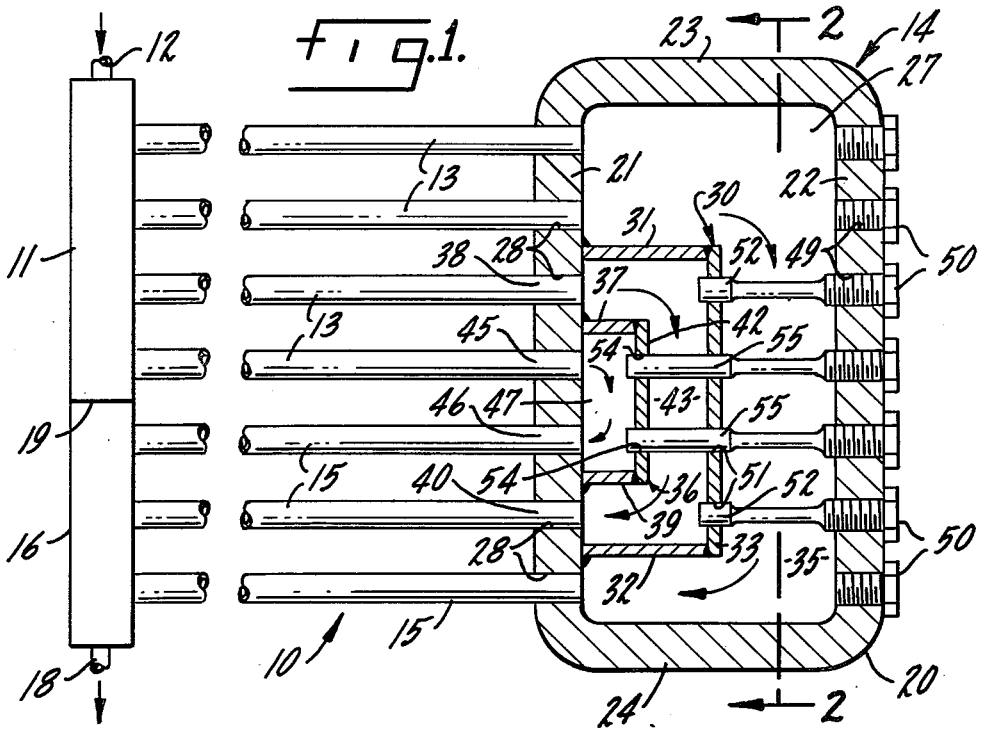
FIG. 1 is a cross-sectional, schematic representation of an embodiment of the invention.

The drawing shows a heat exchanger 10 for condensing a gas, such as steam, to its liquid state. The gas enters fluid inlet header 11 through inlet conduit 12 and flows into a first series of elongated, vertically spaced, parallel, upper condensing tubes 13. As the gas flows through the inside of tubes 13, it is cooled by an external heat exchange fluid, such as air, flowing over the outside of the tubes. The gas, and any condensed liquid, flow out of the upper tubes 13 into the upper portion of a return header 14, and then into a second series of elongated, vertically spaced, parallel, lower condensing tubes 15 in the lower portion of header 14. The gas and condensate flow through the inside of tubes 15 into an outlet header 16. Further cooling of the gas by the external heat exchange fluid, and further condensation occurs in tubes 15. Condensed liquid and gas exit through outlet conduit 18. Plate 19 separates inlet header 11 and outlet header 16.

Return header 14 comprises an enclosed essentially rectangular metal housing 20 having opposite parallel vertical sides 21 and 22 connected by opposite, parallel horizontal sides 23 and 24. Plates 26 and 27 close off the ends of header 14. Side 21 functions as a tube sheet because the ends of tubes 13 and 15 terminate in openings 28 which pass through side 21.

Figure 2:
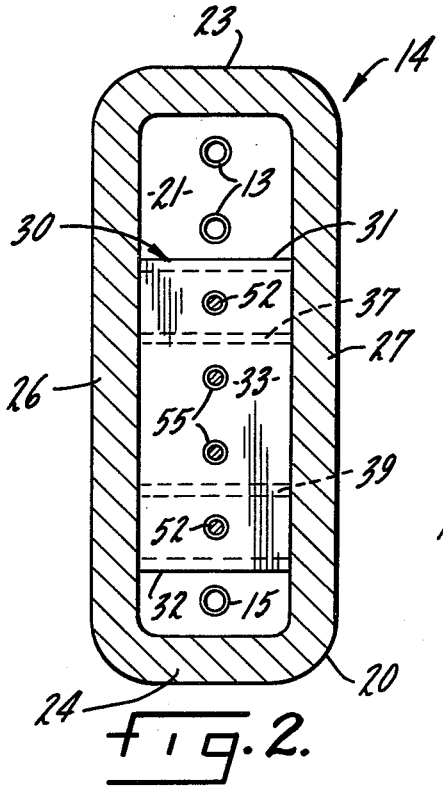
FIG. 2 is a cross-sectional view taken along the line 2—2 of FIG. 1.

The space in housing 20 is divided into a plurality of isolated fluid flow channels which connect one or more predetermined upper tubes 13 to a predetermined lower tube 15 without permitting mixing of the fluid in the respective channels. First baffle means 30 has a side 31 at its upper end welded at a right angle to side 21 below the uppermost tube 13, or alternatively, as shown in FIGS. 1 and 2, below the uppermost pair of tubes 13. A parallel side 32 at the lower end of baffle 30 is welded to side 21 above the lowermost tube 15. A side, or portion, 33 of baffle 30 connects sides 31 and 32 and is parallel to housing sides 21 and 22. Thus, one surface of baffle 30, together with the facing inner surfaces of sides 22, 23, and 24, and the upper and lower portions of side 21 define a first isolated fluid flow channel 35 connecting only the uppermost pair of the tubes 13 with the lowermost tube 15. A second baffle means 36 is enclosed or nested within baffle 30. Baffle 36 has a side 37 at its upper end welded at a right angle to side 21 below a tube 38 in the upper tube series that is second to, or lower than, the uppermost tube or pair of uppermost tubes 13; the end of such second upper tube 38 terminates in an opening 28 located below side 31. A parallel side 39 of baffle 36 is welded to side 21 above a tube 40 in the lower tube series that is second to, or higher than, the lowermost tube 15. The end of such second lower tube 40 terminates in an opening 28 located above side 32. A side or portion 42 of baffle 36 connects sides 37 and 39 and is parallel to housing sides 21 and 22. Thus, the facing surfaces of baffle means 30 and 36, together with portions of side 21 define a second isolated fluid flow channel 43 connecting only tube 38 with tube 40. A tube 45 in the upper tube series that is third or lower to the uppermost tube 13 has its end terminating in an opening 28 located below side 37. A tube 46 in the lower tube series that is third or higher to the lowermost tube 15 has its end terminating in an opening 28 located above side 39. Thus, the facing surfaces of second baffle 36 and side 21 define a third isolated fluid flow channel 47 connecting only tube 45 with tube 46. If heat exchanger 10 had additional vertically aligned tubes 13 and 15, additional baffle means of similar shape could be nested within baffle means 36 so as to define additional isolated fluid flow channels that would connect only one or more predetermined upper tubes 13 to one or more predetermined lower tubes 15.

Side 22 has a series of tapped first cleanout holes 49, one of which is aligned with each opening 28. A threaded plug means 50 is screwed into and seals each hole 49. There is a second cleanout hole 51 in the parallel side 33 of baffle 30 aligned between a hole 49 and each opening 28 in which a second or a third upper or lower tube terminates. The plug 50 in each hole 49 which is aligned with a hole 51 has an integral extension 52 which spans channel 35 and protrudes into and closes its hole 51. There is a third cleanout hole 54 in the parallel side 42 of baffle 36 aligned between a hole 51 and each opening 28 in which a third upper or lower tube terminates. The plug 50 in each hole 49 which is aligned with a hole 54 has an integral extension 55 which spans channel 35, passes through and closes a hole 51, spans channel 43 and protrudes into and closes a hole 54. Thus, the interior of each tube 13 and 15 is easily accessible for cleaning and repair from the outside of header 14. Cleanout holes and plugs similar to holes 49 and plugs 50 may be provided opposite the tube ends in headers 11 and 16.

Figure 3:
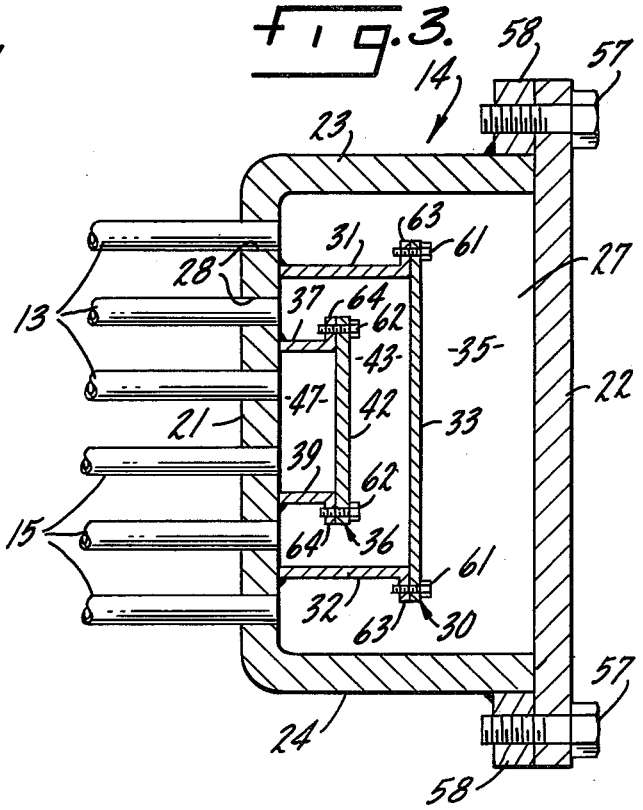
FIG. 3 is a cross-sectional schematic representation of another embodiment of the invention.

FIG. 3 shows another embodiment of the invention which is identical to the embodiment of FIGS. 1 and 2 except that it does not employ cleanout holes and plugs, and only one upper tube 13 is connected to the lowermost tube 15. Instead of being integral with header 14, side 22 is removably attached by bolts 57 threaded into tapped holes in flanges 58. Similarly, parallel sides 33 and 42 are respectively, removably attached by bolts 61 and 62 threaded into tapped holes in flanges 63 and 64. Removal of sides 22, 33 and 42 permits full access to the inside of header 14 and tubes 13 and 15 for cleaning and repair. In all other respects baffle means 30 and 36 function the same way as described previously with regard to the embodiment of FIGS. 1 and 2.

It has thus been shown that by the practice of this invention a heat exchanger for condensing a gas can have a return header 14 in which selected upper and lower tubes 13 and 15 are connected through isolated flow channels 35, 43 and 47 without the disadvantages of U-bends in the tubes. The end of each tube 13 and 15 is readily accessible through the return header 14 for cleaning and repair, and design flexibility is available because different combinations of upper and lower tubes can be connected without mingling of the fluids flowing through them. Also, side 22 can be designed to its full stress capability, instead of being limited by the maximum deflection that would minimize leakage between adjacent passes in prior art exchangers.

While the present invention has been described with reference to particular embodiments, it is not intended to illustrate or describe herein all of the equivalent forms or ramifications thereof. For example, although heat exchanger 10 is shown as having only a single vertical row of tubes 13 and 15, many additional rows may obviously be employed depending on the capacity desired for the exchanger. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A heat exchanger comprising a fluid inlet header; an outlet header; a return header; a first series of elongated, vertically spaced, parallel upper condensing tubes connecting said inlet header to the upper portion of said return header; and a second series of elongated vertically spaced, parallel lower heat exchange tubes connecting the lower portion of said return header to said outlet header; said return header comprising an enclosed housing having a pair of opposite sides; said upper and lower tubes having ends terminating in openings passing through one of said sides; and a plurality of separated baffle means dividing the space in said housing into a plurality of isolated fluid flow channels one of which connects tubes adjacent the center of said heat exchanger, another of which connects tubes adjacent the outer edges of said heat exchanger without permitting mixing of the fluid in the respective channels, the baffle means connecting tubes adjacent the center of said heat exchanger being smaller than and nested within the baffle means connecting tubes adjacent the outer edges of said heat exchanger.

2. The invention defined in claim 1, wherein more than one predetermined upper tubes are connected to a single predetermined lower tube by said one flow channel.

3. The invention defined in claim 1, wherein said baffle means has its upper end connected to said one side below the uppermost tube and its lower end connected to said one side above the lowermost tube, one surface of said baffle means defines a first fluid flow channel connecting said uppermost and lowermost tubes and having the other side of said housing as one of its boundaries; a second upper tube has its end terminating said one side below the upper end of said baffle means; a second lower tube has its end terminating in said one side above the lower end of said baffle means; the other surface of said baffle means defines in part an isolated second fluid flow channel connecting said second upper and lower tubes; there is a first tapped cleanout hole in said other side aligned with each opening in said one side in which a tube end terminates; there is a second cleanout hole in said baffle means aligned with each opening in said one side in which an end of said second upper and lower tubes terminate; and removable threaded plugs close all of said cleanout holes, the plug for each of said second upper and lower tubes comprises a threaded portion screwed into a first cleanout hole and having an integral extension spanning said first channel and extending into and closing a second cleanout hole.

4. The invention defined in claim 1, wherein said baffle means comprises first baffle means having its upper end connected to said one side below the uppermost tube and its lower end connected to said one side above the lowermost tube, said first baffle means defining a fluid flow channel having the other side of said housing as one of its boundaries; second baffle means enclosed within said first baffle means, said second baffle means having its upper end connected to said one side below a second upper tube which has its end terminating in said one side below said upper end of said first baffle means, the lower end of said second baffle means being connected to said first side above a second lower tube which has its end terminating in said one side above said lower end of said first baffle means; said first and second baffle means defining therebetween an isolated flow channel connecting said second upper tube to said second lower tube; a third upper tube having its end terminating in a said first side below said upper side of said second baffle means; a third lower tube having its end terminating in said one side above the lower end of said second baffle means; and said second baffle means and said one side defining therebetween an isolated flow channel connecting said third upper tube to said third lower tube.

5. The invention defined in claim 4, wherein said opposite sides are parallel.

6. The invention defined in claim 5, wherein said first and second baffle means each have a portion which is parallel to said opposite sides.

7. The invention defined in claim 6, wherein said other side is removably attached to said housing; and said parallel sides of said first and second baffle means are also removably attached, whereby said terminal ends of said tubes may be exposed for cleaning.

8. The invention defined in claim 6, wherein there is a first cleanout hole in said other side aligned with each opening in said one side in which a tube end terminates; there is a second cleanout hole in the parallel portion of said first baffle means aligned with each opening in said one side in which an end of said second and third upper and lower tubes terminate; there is a third cleanout hole in the parallel portion of said second baffle means aligned with each opening in said one side in which an end of said upper and lower third tubes terminates; and removable plug means closes all of said cleanout holes.

9. The invention defined in claim 8, wherein said first cleanout holes are tapped; the removable plug means for each of said second upper and lower tubes comprises a threaded member screwed into a first cleanout hole and having an integral extension spanning said first channel and protruding into and closing a second cleanout hole; the removable plug means for each of said third upper and lower tubes comprises a threaded member screwed into a first cleanout hole and having an integral extension spanning said first channel, said extension also passing through and closing a second cleanout hole, and said extension also spanning said second channel and protruding into and closing a third cleanout hole.

10. A heat exchanger comprising a fluid inlet header; an outlet header; a return header; a first series of elongated, parallel, condensing tubes connecting said inlet header to the upper portion of said return header; and a second series of elongated, parallel lower condensing tubes connecting the lower portion of said return header to said outlet header; said return header comprising an enclosed housing having a pair of parallel sides; said upper and lower condensing tubes having ends terminating in openings passing through one of said sides; and means dividing the space in said housing into a plurality of isolated fluid flow channels one of which connects a predetermined upper tube to a predetermined lower tube without permitting mixing of the fluid in the respective channels, comprising first baffle means having its upper end connected to said one side below the uppermost tube and its lower end connected to said one side above the lowermost tube, said first baffle means defining a first fluid flow channel having the other side of said housing as one of its boundaries; second baffle means enclosed within said first baffle means, said second baffle means having its upper end connected to said one side below a second upper tube which has its end terminating in said one side below said upper end of said first baffle means, the lower end of said second baffle means being connected to said first side above a second lower tube which has its end terminating in said one side above said lower end of said first baffle means; said first and second baffle means each having a portion which is parallel to said sides of said housing; said first second baffle means defining therebetween an isolated second fluid flow channel connecting said second upper tube to said second lower tube; a third upper tube having its end terminating in a said first side below said upper side of said second baffle means; a third lower tube having its end terminating in said one side above the lower end of said second baffle means; and said second baffle means and said one side defining therebetween a third isolated fluid flow channel connecting said third upper tube to said third lower tube; there being a first tapped cleanout hole in said other side aligned with each opening in said one side in which a tube end terminates; there being a second cleanout hole in the parallel portion of said first baffle means aligned with each opening in said one side in which an end of said second and third upper and lower tubes terminates; there being a third cleanout hole in the parallel portion of said second baffle means aligned with each opening in said one side in which an end of said upper and lower third tubes terminates; and removable threaded plugs closing all of said cleanout holes; the plug for each of said second upper and lower tubes comprising a threaded member screwed into a first cleanout hole and having an integral extension spanning said first channel and protruding into and closing a second cleanout hole; the plug for each of said third upper and lower tubes comprising a threaded member screwed into a first cleanout hole and having an integral extension spanning said first channel, said extension passing through and closing a second cleanout hole, said extension also spanning said second channel and protruding into and closing a third cleanout hole.

11. A heat exchanger comprising a fluid inlet header; an outlet header; a return header; a first series of elongated, parallel upper condensing tubes connecting said inlet header to the upper portion of said return header; and a second series of elongated, parallel lower condensing tubes connecting the lower portion of said return header to said outlet header; said return header comprising an enclosed housing having a pair of parallel sides; said upper and lower condensing tubes having ends terminating in openings passing through one of said sides; and means dividing the space in said housing into a plurality of isolated fluid flow channels, one of which connects a predetermined upper tube to a predetermined lower tube without permitting mixing of the fluid in respective channels, comprising first baffle means having its upper end connected to said one side below the uppermost tube and its lower end connected to said one side above the lowermost tube, said first baffle means defining a first fluid flow channel having the other side of said housing as one of its boundaries; second baffle means enclosed within said first baffle means, said second baffle means having its upper end connected to said one side below a second upper tube which has its end terminating in said one side below said upper end of said first baffle means, the lower end of said second baffle means being connected to said first side above a second lower tube which has its end terminating in said one side above said lower end of said first baffle means; said first and second baffle means each having a side which is parallel to said parallel sides of said housing; said first second baffle means defining therebetween a second isolated fluid flow channel connecting said second upper tube to said second lower tube; a third upper tube having its end terminating in a said first side below said upper side of said second baffle means; a third lower tube having its end terminating in said one side above the lower end of said second baffle means; and said second baffle means and said one side defining therebetween a third isolated fluid flow channel connecting said third upper tube to said third lower tube; said other side of said housing being removably attached, and said parallel sides of said first and second baffle means also being removably attached, whereby said terminal ends of said tubes may be exposed for cleaning.

12. The invention defined in claim 11, wherein said housing and said first and second baffle means each has a pair of flanges to which its respective removable side is bolted.

* * * * *